United States Patent [19]

Salsich et al.

[11] 4,112,280

[45] Sep. 5, 1978

[54] THERMAL PROCESSOR

[75] Inventors: Robert Charles Salsich, Canandaigua; Roger Edwin Bartell, Rochester, both of N.Y.

[73] Assignee: Eastman Kodak Company, Rochester, N.Y.

[21] Appl. No.: 819,797

[22] Filed: Jul. 28, 1977

[51] Int. Cl.[2] ..... H05B 1/00

[52] U.S. Cl. ..... 219/216; 219/388; 219/469

[58] Field of Search ..... 219/216, 388, 469–471; 355/3 FU; 432/59, 227, 60, 228

[56] References Cited

U.S. PATENT DOCUMENTS

| | | | |
|---|---|---|---|
| 2,588,966 | 3/1952 | Dale | 219/469 |
| 3,632,984 | 1/1972 | Brownscombe | 219/469 |
| 3,952,696 | 4/1976 | Saupe | 432/228 |

FOREIGN PATENT DOCUMENTS

| | | | |
|---|---|---|---|
| 1,056,549 | 1/1967 | United Kingdom | 219/216 |

*Primary Examiner*—C. L. Albritton

*Attorney, Agent, or Firm*—John D. Husser

[57] ABSTRACT

Apparatus for heat processing sheet or web material includes a rotary drum and guide web of low friction coefficient and idler rollers which cooperate with the moving drum to effect feed of the material through the processing path.

7 Claims, 2 Drawing Figures

THERMAL PROCESSOR

BACKGROUND OF THE INVENTION

1. Field of the Invention

The present invention relates to the processing of thermally developable recording materials and more specifically to improved apparatus for heating such recording materials in sheet or web form.

2. Description of the Prior Art

Various imaging materials are known which utilize heat development following an imagewise exposure, e.g., by electrical charge, light or other forms of electromagnetic radiation; and many different devices have been utilized for thermally processing such materials. Common requirements for such devices are a well controlled and uniform application of heat, a rapid and efficient heat transfer to minimize energy usage and a reliable feed means which obviates material jams and conserves the power required for material transport.

Various approaches have been utilized, e.g., hot air heating, infrared heating, microwave heating, etc.; however, a simple and common approach has been conductive heating by moving sheet or web to be developed in intimate contact with a heated member. One common configuration for implementing the last mentioned approach utilizes a rotating heated drum, on which the sheet or web is moved from an entrance zone to an exit zone around the drum periphery. To maintain the sheet in intimate contact with the drum during rotation along the development path, a stationary support, e.g., a belt, or blanket, or shoe, has been located around the drum periphery, usually spring-biased into contact with the rotating drum. These processors often rely on the friction force between the drum and copy material, which is higher than the friction force between the copy material and stationary support, to effect transport of the copy material through the processing zone. Another, somewhat similar, kind of apparatus utilizes a stationary heated member, (e.g., a drum or platen) over which a continuous belt is moved to transport the copy material and hold it in close contact with the heated member. In this latter configuration the frictional force between the moving belt and copy material is greater than between the stationary heated member and sheet.

In both configurations described above high drive force requirements can be encountered, particularly when large width material is to be processed. Also, the high frictional forces and contact pressures utilized in such systems can damage the sheet or web material.

SUMMARY OF THE INVENTION

The present invention pertains to heat processing apparatus of the kind described above and it is an object of the present invention to provide an improved processor which accomplishes the general requirements indicated but avoids the disadvantages of prior art approaches.

It is thus an object of the present invention to provide improved apparatus for developing heat processable sheet or web material.

It is a further object of the present invention to provide such apparatus which avoid use of frictional moving forces from a member defining the heating zone, yet which is simple and inexpensive to manufacture yet reliable in performance.

The above and other objects and advantages are achieved in accordance with the present invention by providing a rotated heated drum and stationary web support which both have operative surfaces of low frictional coefficient. Thus large frictional forces are not presented on copy material during passage through the processing zone, and instead, the copy material is moved through the processing zone by drive means at the entrance and exit of the processing path, which receive drive from the moving drum.

BRIEF DESCRIPTION OF THE DRAWINGS

Preferred embodiments of the present invention are hereinafter described with reference to the attached drawings which form a part hereof and in which.

DETAILED DESCRIPTION OF THE PREFERRED EMBODIMENTS

Figure 1:
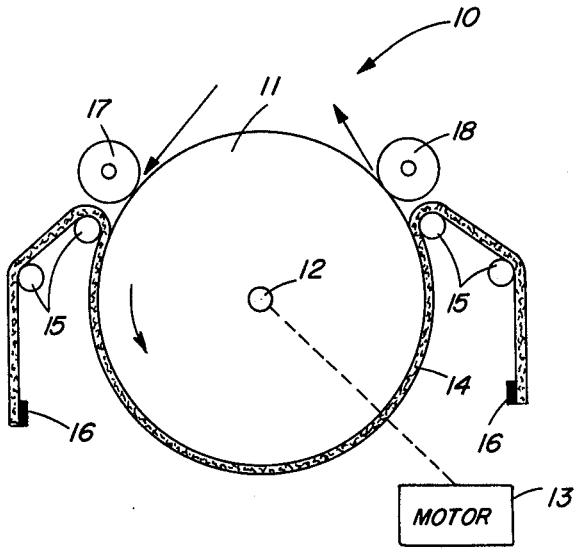
FIG. 1 is a schematic end view of one preferred embodiment of the present invention.

The processing apparatus 10, shown in FIG. 1, comprises a cylindrical drum 11 mounted for rotation with a shaft 12 by a motor 13. The drum preferably has an internal heat source which maintains the drum's peripheral surface at a substantially constant temperature. One highly useful heating configuration can be a vapor heater such as disclosed in Research Disclosure No. 14984, Volume No. 149, pages 96 and 97, September, 1976, published by Industrial Opportunities Ltd., Homewell, Havant, Hampshire, P09 1EF, United Kingdom. However, other kinds of heated drums can be used, e.g., drums containing heated oil, or a thermostat controlled infrared light source. Defining the material processing path, around the lower section of the drum's rotary path, is a guide belt 14. In the FIG. 1 configuration, end portions of belt 14 extend over support rods 15 and have weight members 16 attached thereto.

In accordance with the present invention the contacting surfaces of drum 12 and belt 14 should be selected for minimal frictional force on a processed sheet or web. One useful combination of materials has been found to be a polished stainless steel surface on the drum and a Fiberglas belt with a Teflon overcoating. Other low coefficient of friction, heat conductive surfaces can be used for the drum surface. Similarly the belt can be formed of other low coefficient of friction material which is heat-resistant.

Also in accordance with the present invention, the weights 16 should be selected so that their gravitational forces do not urge a belt-drum contact force larger than is required for holding the copy material in intimate heat transfer contact with the drum. For example, with a drum of 8 inch diameter and 24 inch length and a feed path about 18 inches, weights in the range of 50–750 g. have been found useful, with belt and drum surfaces such as described above. However, optimum values for such weight vary somewhat depending on the type of material being processed.

Since the processing path is designed for minimal frictional force on the copy material, drive must be provided for moving the material along the path. In accordance with the present invention, such drive is taken from rotary movement of the drum. In the FIG. 1 embodiment, such drive is accomplished by idler rollers 17 and 18, located respectively at the entrance and exit to the processing path. The rollers desirably extend the full length of the drum and can be formed with frictional surfaces, e.g., of silicone rubber. The rollers have end support means, not shown, and can be gravity or spring urged into contact with the drum surface to create zones of drive-inducing normal forces between the rollers and the drum surface. Upon moving the leading end of copy material into the entrance of the processing path, indicated by the arrow in FIG. 1, the cooperation of drum 11 and roller 17 feeds the material around the path until the leading end passes beneath the exit roller 18. It will be appreciated that the processor 10 must be designed so that the distance along the processing path, between rollers 17 and 18 is less than the shortest length of material to be processed so that roller 18 will have engaged and drive the material before the trailing edge leaves engagement with roller 17.

Figure 2:
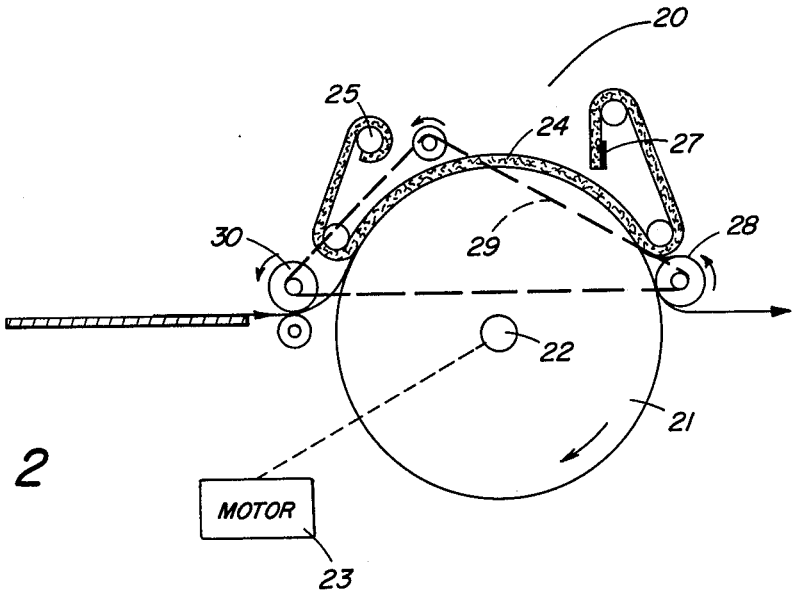
FIG. 2 is a schematic end view of an alternative preferred embodiment of the present invention.

FIG. 2 discloses another embodiment of the present invention, useful for processing shorter lengths of material. This processing apparatus 20 comprises a similar drum 21, mounted for rotation on shaft 22 by motor 23. In this embodiment, belt 24 is attached at one end to rods 25 and supported around rods 26 as shown so that weighted end 27 exerts a retaining force. The copy material drive in this embodiment is effected by a different drive system than in FIG. 1. Specifically, idler roller 28 at the exit path supported in contact with the drum surface and in turn is drivingly coupled by drive belt 29 to entrance drive roller 30. This configuration has been found particularly useful in processing materials which expand in width upon heating. That is, by spacing the drive roller 30 and its idler 31 away from the drum, such materials have opportunity to expand before being confined between the belt and drum. This has been found to eliminate wrinkles or "fluting" in the copy material.

The invention has been described in detail with particular reference to certain preferred embodiments thereof, but it will be understood that variations and modifications can be effected within the spirit and scope of the invention.

I claim:

1. Apparatus for thermal development of imaging material, said apparatus comprising:

(a) a development drum mounted for rotation on a central axis, said drum having a peripheral surface with a low coefficient of friction;

(b) means for rotating said drum;

(c) means for heating said drum surface;

(d) means providing a stationary, low-coefficient-of-friction, support surface extending around a portion of said drum from a material inlet to a material outlet;

(e) means for urging said support surface toward the successive portions of the drum surface moved therepast, the force provided by said urging means being sufficient to maintain material between said drum and said support surface in heat transfer relation with said drum but insufficient to create any substantial drive transmission forces between such material and said drum; and (f) first and second drive-inducing means located respectively proximate said inlet and said outlet, at least one of said drive-inducing means being an idler roller mounted with respect to said drum surface in a manner creating normal forces, between contiguous portions of said roller and drum surface, of magnitude effecting transport by said drum of interposed material.

2. The invention defined in claim 1 wherein both of said drive-inducing means are idler rollers in drive receiving engagement with said drum surface.

3. The invention defined in claim 1 wherein said first drive-inducing means is spaced from the peripheral surface of said drum by a distance sufficient to allow heat expansion of imaging material prior to movement between said support surface and said drum.

4. The invention defined in claim 1 further including means for transmitting rotary drive from said second drive-inducing means to said first drive means.

5. Apparatus for heating thermally developable recording material, said apparatus comprising:

(a) a development drum having a low friction peripheral surface and being mounted for rotation on a central axis;

(b) drive means for rotating said drum;

(c) means for heating said drum surface;

(d) a stationary retaining belt extending around a portion of said drum surface from a material inlet to a material outlet, the surface of said belt which contacts said drum surface being formed of low friction material;

(e) means for urging said belt toward said drum periphery, the forces toward said drum provided by said urging means being sufficient to maintain such material in heat transfer relation with said drum but insufficient to create substantial drive transmission forces between the material and said drum; and (f) first and second idler rollers, located respectively proximate said inlet and said outlet, at least one of said rollers being mounted with respect to said drum surface so as to create successive zones of normal forces, between contiguous portions of said roller and said drum surface, of magnitude effecting transport by said drum of interposed material.

6. The invention defined in claim 5 wherein both of said idler rollers are in engagement with said drum surface.

7. The invention defined in claim 5 wherein said first idler roller is proximate said inlet and is spaced from the peripheral surface of said drum by a distance sufficient to allow heat expansion of imaging material prior to movement between said belt and said drum and further including means for transmitting rotary drive from said second idler roller to said first idler roller.

* * * * *